US008827329B2

(12) United States Patent
Scholz et al.

(10) Patent No.: US 8,827,329 B2
(45) Date of Patent: Sep. 9, 2014

(54) LOCK UNIT HAVING A MULTI-PAWL LOCKING MECHANISM

(75) Inventors: Michael Scholz, Essen (DE); Oliver Götz, Essen (DE)

(73) Assignee: Kiekert AG, Heiligenhaus (DE)

( * ) Notice: Subject to any disclaimer, the term of this patent is extended or adjusted under 35 U.S.C. 154(b) by 410 days.

(21) Appl. No.: 13/120,156

(22) PCT Filed: Sep. 18, 2009

(86) PCT No.: PCT/DE2009/001320

§ 371 (c)(1), (2), (4) Date: Mar. 21, 2011

(87) PCT Pub. No.: WO2010/034295

PCT Pub. Date: Apr. 1, 2010

(65) Prior Publication Data

US 2011/0169280 A1 Jul. 14, 2011

(30) Foreign Application Priority Data

Sep. 24, 2008 (DE) ..... 10 2008 048 712

(51) Int. Cl.

| | |
|---|---|
| ***E05C 3/06*** | (2006.01) |
| ***E05B 85/26*** | (2014.01) |
| *E05C 3/16* | (2006.01) |
| *E05B 15/16* | (2006.01) |

(52) U.S. Cl.

CPC ..... *E05B 85/26* (2013.01); *E05B 2015/1685* (2013.01); *Y10S 292/23* (2013.01)

USPC ..... 292/216; 292/200; 292/DIG. 23

(58) Field of Classification Search

USPC ..... 292/200, 216, DIG. 23

See application file for complete search history.

(56) References Cited

U.S. PATENT DOCUMENTS

| | | | | |
|---|---|---|---|---|
| 4,948,184 | A * | 8/1990 | Weyerstall et al. | 292/216 |
| 7,500,700 | B2 * | 3/2009 | Kunst | 292/201 |
| 8,235,428 | B2 * | 8/2012 | Hunt et al. | 292/216 |
| 8,596,696 | B2 * | 12/2013 | Cumbo et al. | 292/216 |
| 2005/0073156 | A1 | 4/2005 | Oh | |
| 2010/0052336 | A1 * | 3/2010 | Bendel et al. | 292/196 |
| 2011/0127780 | A1 * | 6/2011 | Barth et al. | 292/213 |

FOREIGN PATENT DOCUMENTS

| | | | |
|---|---|---|---|
| CN | 1122870 | A | 5/1996 |
| CN | 1603561 | A | 4/2005 |
| CN | 2809129 | Y | 8/2006 |
| DE | 19937405 | * | 2/2001 |
| DE | 201 04 625 | U1 | 9/2002 |
| EP | 1 380 715 | A1 | 1/2004 |
| WO | 2008/061491 | A1 | 5/2008 |

* cited by examiner

*Primary Examiner* — Carlos Lugo

(74) *Attorney, Agent, or Firm* — Renner, Otto, Boisselle & Sklar, LLP

(57) ABSTRACT

The invention relates to a lock unit (1) for a motor vehicle (2) comprising at least one catch (3) with a first position (4) and a primary position (5), a first pawl (6) with a pawl axis of rotation (7), which is engageable with the primary position (5), a second pawl (8) mounted on the pawl axis of rotation (7) and engageable with the first position (4), a blocking lever (9) with a blocking lever axis of rotation (10), which blocks the second pawl (6) when the first pawl (6) engages the catch (3), and a release lever (11) for pivoting at least the blocking lever (10), wherein the release lever (11) during the opening process interacts with the blocking lever (9) such that the first pawl (6) and the blocking lever (9) are pivoted in the same rotational direction (12).

20 Claims, 4 Drawing Sheets

LOCK UNIT HAVING A MULTI-PAWL LOCKING MECHANISM

CROSS-REFERENCE TO RELATED APPLICATIONS

This is a National Stage Application of International Patent Application No. PCT/DE2009/001320, with an international filing date of Sep. 18, 2009, which is based on German Patent Application No. 10 2008 048 712.0, filed Sep. 24, 2008.

BACKGROUND OF THE INVENTION

1. Field of the Invention

The present invention relates to a lock unit for a motor vehicle comprising at least one catch with a first position and a primary position and two pawls, which block the catch in certain positions. To block the catch by the first pawl in the primary position, a blocking lever is provided, which blocks the first pawl. Such lock units with multi-part latches are known, for example, from WO 2008/061491 A1.

2. Brief Description of the Related Art

The use of such units with a multi-part lock pawl has been proven and is characterized, in particular, by high operational comfort and low noise during the operation of the lock unit. Such lock units are used particularly in the doors and/or hatches of motor vehicles.

However, there is a need to achieve further improvements thereof. In particular, a main focus is on the operating convenience and small installation area.

In that regard, it is an object of the present invention to provide a solution, at least in part, to the illustrated problems relative to the prior art. In particular, a lock unit is desired which saves space and can be operated quickly and quietly.

BRIEF DESCRIPTION OF THE INVENTION

These tasks are achieved with a locking device having the features as in claim 1. Advantageous embodiments of the locking device are given in the dependent claims. It should be noted that in the claims, individually listed features can be combined in any technologically sensible way and to show further embodiments of the invention. The description, particularly in relation to the drawings, further illustrates the invention and shows additional examples.

The inventive lock unit for a motor vehicle comprises at least the following components:

- a catch with a first position and a primary position,
- a first pawl with a pawl axis of rotation, which is engageable with the primary position,
- a second pawl mounted on the pawl axis of rotation and engageable with the first position,
- a blocking lever with a blocking lever axis of rotation, which blocks the first pawl when the first pawl engages with the catch, and
- a release lever for pivoting at least the blocking lever, wherein the release lever during the opening movement interacts with the blocking lever such that the first pawl and the blocking lever are pivoted in the same rotational direction.

As stated in the introduction, the lock unit is used in particular for locking doors in a motor vehicle. Of course, the lock unit may comprise additional elements, levers, Bowden cables, mounts and the like, in addition to the above-mentioned components. The following description is, however, confined to the design of a multi-pawl locking mechanism.

The catch is used, in particular, to securely hold in place a catch bolt at a vehicle door. It is already known that the catch should be secured in a position between the open position and the closed position, i.e., in a so-called first position, such that release of the catch bolt is prevented. When the catch has reached its desired orientation in the closed position of the lock unit, the catch is secured by being blocked at its primary position. Frequently, the first position and the primary position are stop faces disposed on the surface or the periphery of the catch.

It is preferred that the catch, the first pawl, the second pawl, the blocking lever, and the release lever have metallic bodies and are stamped components.

In the locking mechanism taught herein, the first pawl and second pawl are pivotably disposed on a common axis of rotation, and may be spring-biased. One pawl is used for locking the catch in the primary position (first pawl) and another pawl is used for locking the catch in the first position (second pawl). This means, in particular, that the first pawl and second pawl are engaged with the catch at different times and at different positions.

The engagement between the first pawl and the catch is such that the first pawl does not block the catch alone or by itself. Instead, the engagement between the first pawl and the catch is such that the catch exerts a force onto the first pawl, so that the first pawl is moved into a position that releases the catch. In order to ensure, however, that the first pawl fits securely against the primary position of the catch when the locking mechanism is closed, pivoting of the first pawl is prevented by the blocking lever, which presses against or holds tightly the first pawl against the catch or the primary position.

To initiate the opening process, the blocking lever is lifted away from the first pawl such that the first pawl is pushed away from the catch by the catch itself. To pivot the blocking lever, provided is a release lever, which causes the blocking lever to pivot at the beginning of the opening process.

The first pawl, the second pawl, and at least also the blocking lever are each implemented as a pivoting lever, i.e., each is pivotable around its axis of rotation (in a limited pivoting range). For the opening process, the components are arranged such that the first pawl and the blocking level are pivoted in the same direction. When the first pawl carries out rotation in a particular direction (e.g., clockwise) during its withdrawal away from the primary position, the blocking lever or the release lever become oriented such that the blocking lever pivots also in the same particular direction (clockwise). In this way, the blocking lever can be removed from the pivoting pathway of the first pawl only after a short pivoting motion such that the desired release of the catch can be achieved with particularly small movements.

In addition, it is considered advantageous that the release lever pivots the second pawl during the opening movement. The pivoting of the second pawl with the release lever may occur at the same time as the pivoting of the blocking lever, or it may be delayed in time. For this purpose, the release lever can have a plurality of legs, which rest directly against the blocking lever or the second pawl, with or without a certain play, in the closed position of the lock unit.

Precisely in this context, it is considered advantageous that the release lever pivots the blocking lever and the second pawl in the same direction. In this way, a particularly space-saving arrangement of the two pawls, the blocking lever, and the release lever can be achieved, wherein the release lever is disposed, e.g., between the pawls and the blocking lever. The function of the mechanism is such that the release lever moves the blocking lever in a desired direction, at the same time (or with a delay) the release lever also pivots the second pawl in the same direction, and, in addition, the first pawl is also pivoted in the same direction due to force transfer from the catch (3) (which is spring-loaded).

In addition, it is considered advantageous that the release lever pivots around an axis of rotation. In this case, the release lever is also implemented as a pivoting lever. To achieve a particularly space-saving arrangement of the various levers, the release lever is pivoted in a rotational direction that is opposite to the rotational direction of the first pawl and the blocking lever (and the second pawl).

It is also considered advantageous that the second pawl is contacted with a reset spring that opposes the motion of the second pawl during the opening process. The reset spring also acts on the second pawl such that the second pawl is biased permanently toward the catch to ensure a secure fit against a stop and/or the catch. In any case, the second pawl is moved directly against the first position during the closing movement of the lock unit as soon as the catch has carried out the necessary pivoting motion. The reset spring is preferably mounted opposite to the catch with respect to the second pawl.

Finally, a motor vehicle is proposed, comprising at least one inventive lock unit described herein. Such a lock unit is provided, in particular, for locking doors and/or hatches of motor vehicles.

The invention and the technical background are explained in more detail hereinbelow with reference to the drawings. It should be noted that the drawings show particularly preferred embodiments of the invention, but the invention is not limited to these embodiments.

DETAILED DESCRIPTION OF THE INVENTION

Figure 1:
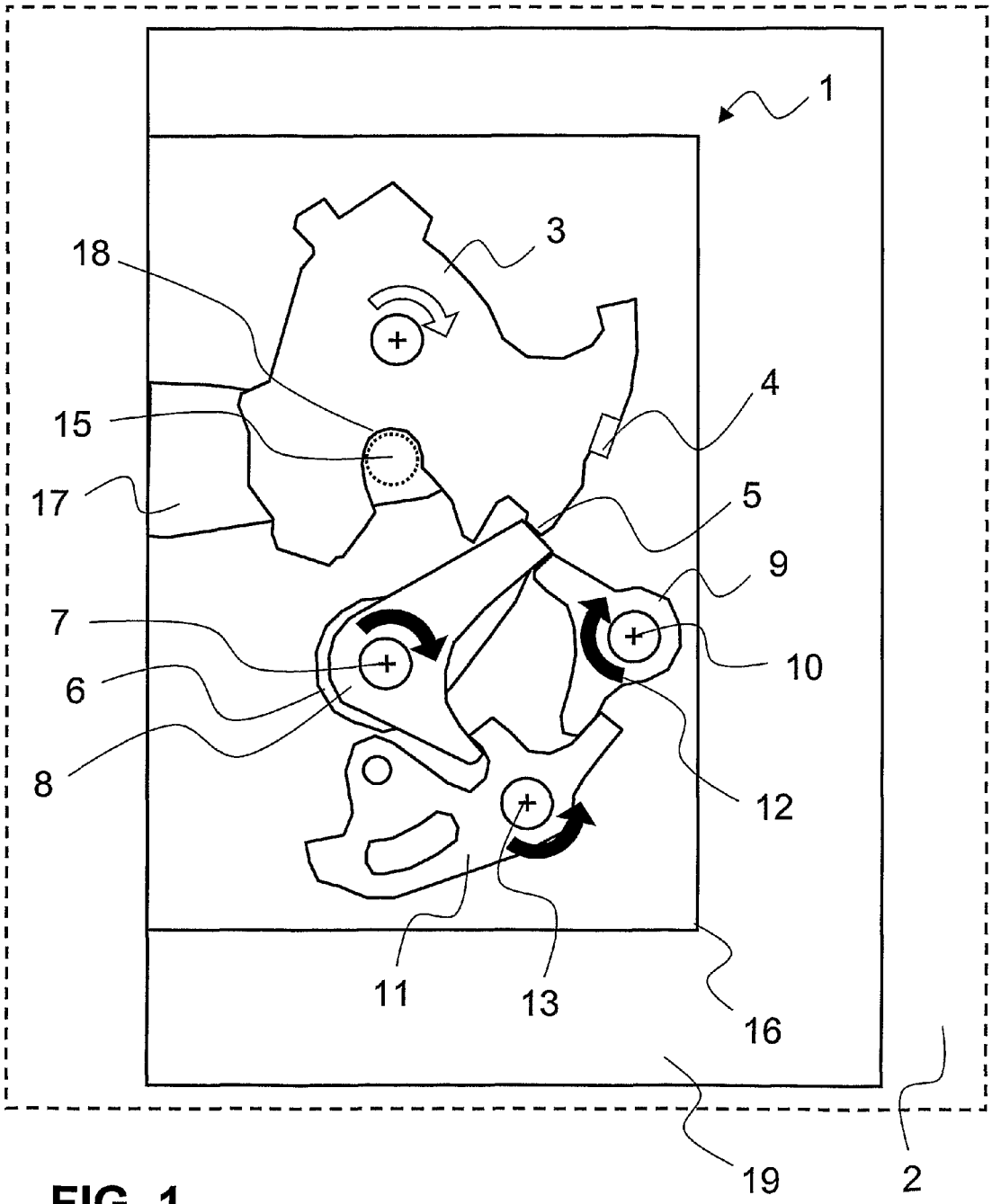
FIG. 1 shows a first embodiment of the inventive lock unit in a locked state.

FIG. 1 schematically shows a motor vehicle 2 with a door 19 implemented with the inventive lock unit 1. The lock unit 1 is preferably arranged in a housing 16. In the housing 16, there is also an inlet opening 17 for receiving the catch bolt 15 attached to the body of the motor vehicle 2. FIG. 1 shows the lock unit 1 in a locked position, in which the catch 3 holds the catch bolt 15 securely in the inlet 18 provided for this purpose. The catch 3 is implemented with a primary position 5 and a first position 4.

In the pivoting range of the catch 3 are provided two pawls, both of which are rotatably disposed on the axis of rotation 7 of the first pawl. The second pawl 8, which is easily seen from above, has no contact with the catch 3 in this locked position. Below the second pawl 8 is disposed a first pawl 6, which lies directly against the primary position 5 of the catch 3.

The catch 3 exerts a force on the first pawl 6. This force results partly from a spring, which moves the catch 3 in the opening direction (white arrow), as well as from the transfer of force via the catch bolt 15 or the door seals, which are pressed together between the door 19 and the body of the vehicle 2. In order to prevent the first pawl 6 from being pushed away from the catch 3, provided is a blocking lever 9 with a blocking lever axis of rotation 10. The pawl axis and the blocking lever axis are arranged away from each other.

The blocking lever 9 can be operated via the release lever 11 when the opening process is initiated. The release lever 11 has a release lever axis 13, which is located away from the pawl axis 7 and the blocking lever axis 10. It is preferred that the axis of rotation of the catch and the release lever axis 13 are disposed on opposite sides of an imaginary line connecting the pawl axis 7 and the blocking lever axis 10.

The directions of rotation 12 of the components of the lock unit 1 during the opening movement are indicated by black arrows. The opening process is initiated by means of the release lever 11, which is pivoted counterclockwise about the release lever axis 13. The release lever 11 directly contacts the blocking lever 9, whereby the blocking lever 9 is pivoted in the rotational direction 12 (clockwise). In this way, the blocking lever 9 moves away very rapidly from the pivoting range or from the contact surface with the first pawl 6 such that the first pawl 6 is pushed away by the opening movement of the catch and the catch is free to move. In addition, the release lever 11 causes, during its movement, the second pawl 8 to pivot. In this way, the first pawl 6 and the second pawl 8 both pivot in the clockwise direction.

Figure 2:
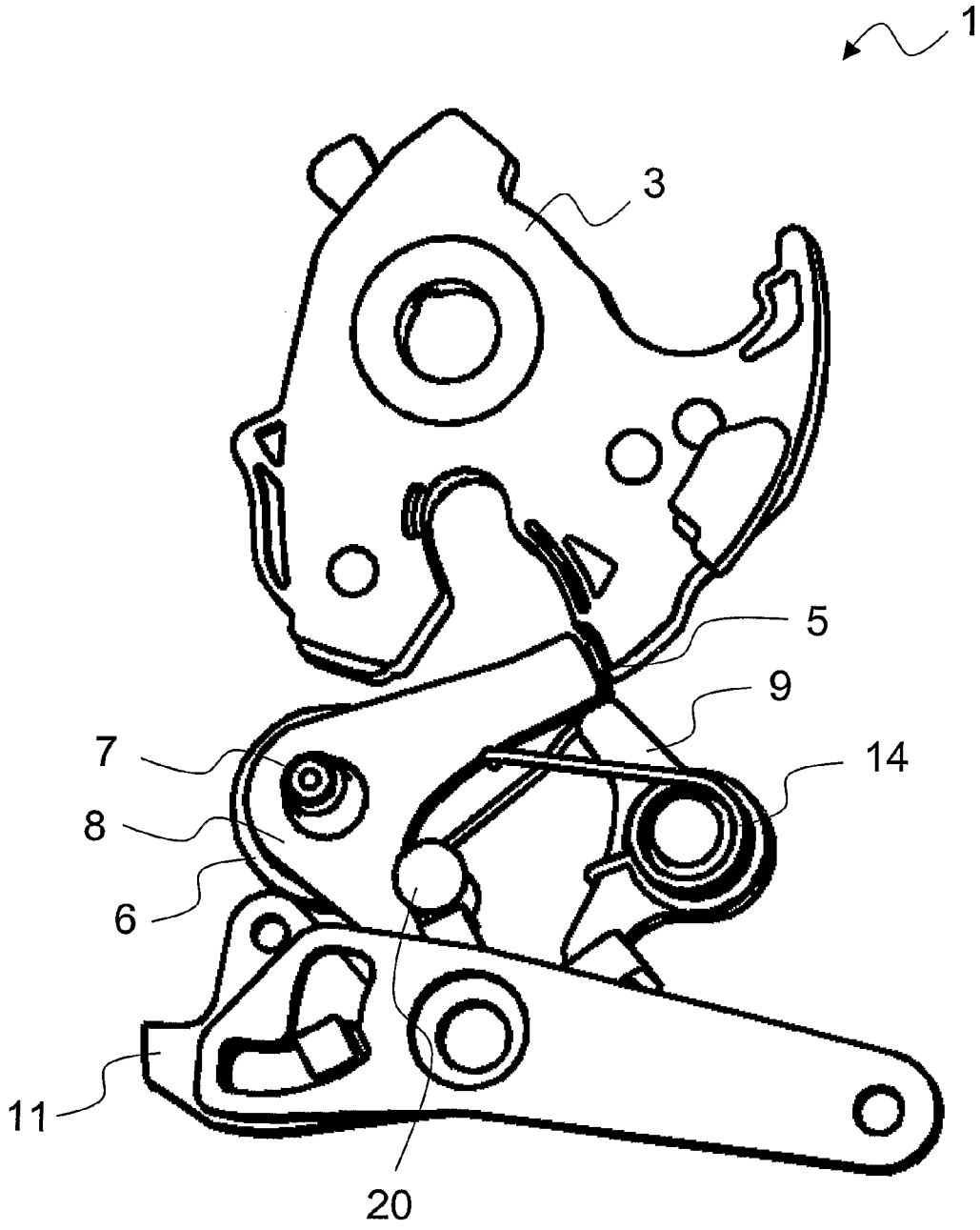
FIG. 2 shows a variant of the lock unit, in which the first pawl is engaged with the primary position of the catch.
Figure 3:
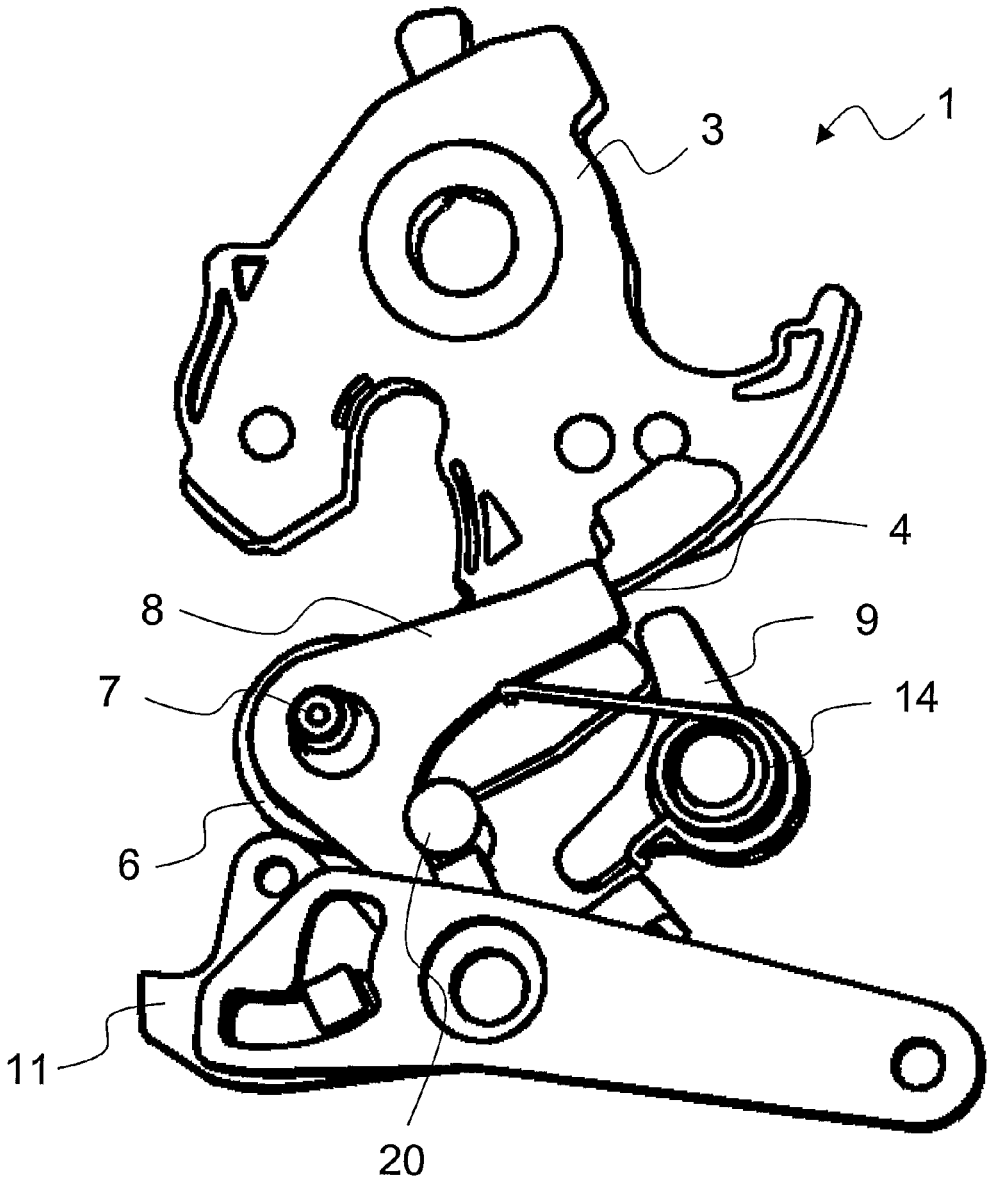
FIG. 3 shows the embodiment of FIG. 2, wherein the second pawl is engaged with the first position of the catch.
Figure 4:
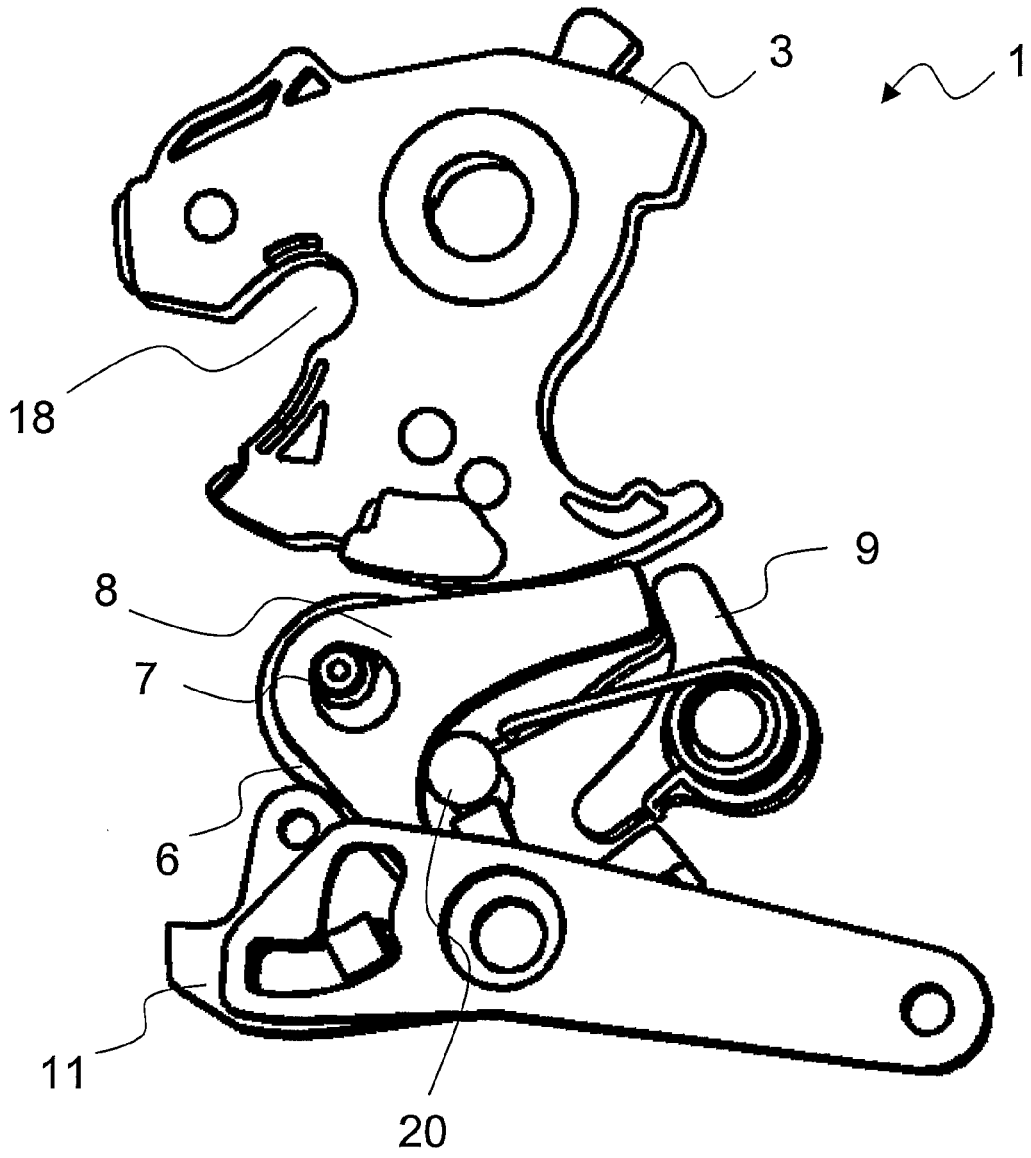
FIG. 4 shows the embodiment of FIGS. 2 and 3 in the open position.

FIGS. 2, 3 and 4 show a multi-pawl locking mechanism of the lock unit 1 in three different positions. In the upper area of the drawings is visible the catch 3. Below the catch 3 are visible the first pawl 6 and the second pawl 8, both of which are rotatably disposed on the pawl axis of rotation 7. To the right next to the first pawl 6 and the second pawl 8 is shown the rotatable blocking lever 9. In addition, a reset spring 14 is provided on the blocking lever axis 10, which acts on the blocking lever 9 and the second pawl 8. Below the pawls and the blocking lever is visible the release lever 11. However, the release lever 11 is partially foreshadowed in these drawings by an additional lever.

In the closed position, as shown in FIG. 2, the first pawl 6 lies directly against the primary position 5 of the catch 3. The first pawl 6 is blocked in this position by a corresponding leg of the blocking lever 9. Another leg of the blocking lever 9 lies directly against the release lever 11. The second pawl 8 is pushed counterclockwise by means of the reset spring 14 and lies safely against the stop 20. The release lever 11 is arranged with a small amount of free play in front of the corresponding leg of the second pawl 8. In this case, the actuation of the blocking lever 9 and the second pawl 8 by the release lever 11 is asynchronous.

FIG. 3 shows the position, in which the second pawl 8 engages with the catch 3. The catch 3 has a laterally-extending first position 4, which extends away from the catch 3 and contacts with the second pawl 8. Compared to FIG. 3, the second pawl 8 does not change its orientation in the primary position and first position. Instead, its position is well-defined by the reset spring 14 and the stop 20. In contrast, the first pawl 6 is deflected and contacts the periphery of the catch 3. The blocking lever 9 lies in the range of the blocking area of the first pawl 6 and has no contact with the release lever 11, but is biased in the counterclockwise direction. Based on the position of the components shown in FIG. 3, the catch 3 is rotated further in the counterclockwise direction, e.g., by an electric drive, such that the spring-loaded components are moved into the position, as shown in FIG. 2, when the catch 3 reaches a corresponding position.

In FIG. 4 is shown the open position. In this situation, both the first pawl 6 and the second pawl 8 contact the periphery of the catch 3 outside the first position and the primary position. They are both biased by a spring against the catch. In the illustrated position of the catch 3, the catch blot can readily leave the inlet 18 or enter the inlet 18 to initiate a new closing process.

The invention allows for the production of particularly quiet lock units, which can be operated with high comfort and small force (due to a smaller pivoting range of the pawls).

Reference List

1. Lock unit
2. Motor vehicle
3. Catch
4. First position
5. Primary position
6. First pawl
7. Pawl axis of rotation
8. Second pawl
9. Blocking lever
10. Blocking lever axis of rotation
11. Release lever
12. Rotational direction
13. Release lever axis of rotation
14. Reset spring
15. Catch bolt
16. Housing
17. Inlet opening
18. Seat
19. Door
20. Stop

The invention claimed is:

1. A lock unit comprising:

a catch with a first position and a primary position, a first pawl with a pawl axis, which is engageable with said primary position, a second pawl, which is rotatably disposed on said pawl axis and is engageable by direct contact with said first position, a blocking lever with a blocking lever axis, which arrests by direct contact said first pawl when said first pawl engages said catch, and a release lever for pivoting at least said blocking lever, wherein said release lever during an opening movement interacts with said blocking lever such that said first pawl and said blocking lever pivot in the same direction of rotation.

2. The lock unit of claim 1, wherein said release lever pivots said second pawl during the opening movement.

3. The lock unit of claim 2, wherein said release lever simultaneously pivots the blocking lever and the second pawl in the same direction of rotation.

4. The lock unit of claim 1, wherein said release lever is rotatable around a release lever axis.

5. The lock unit of claim 1, wherein said second pawl is contacted with a reset spring, which, during the opening movement, opposes the motion of said second pawl in the direction of rotation.

6. A motor vehicle comprising at least one lock unit of claim 1.

7. The lock unit of claim 2, wherein said release lever is rotatable around a release lever axis.

8. The lock unit of claim 3, wherein said release lever is rotatable around a release lever axis.

9. The lock unit of claim 2, wherein said second pawl is contacted with a reset spring, which, during the opening movement, opposes the motion of said second pawl in the direction of rotation.

10. The lock unit of claim 3, wherein said second pawl is contacted with a reset spring, which, during the opening movement, opposes the motion of said second pawl in the direction of rotation.

11. The lock unit of claim 4, wherein said second pawl is contacted with a reset spring, which, during the opening movement, opposes the motion of said second pawl in the direction of rotation.

12. The lock unit of claim 7, wherein said second pawl is contacted with a reset spring, which, during the opening movement, opposes the motion of said second pawl in the direction of rotation.

13. The lock unit of claim 8, wherein said second pawl is contacted with a reset spring, which, during the opening movement, opposes the motion of said second pawl in the direction of rotation.

14. A motor vehicle comprising at least one lock unit of claim 2.

15. A motor vehicle comprising at least one lock unit of claim 3.

16. A motor vehicle comprising at least one lock unit of claim 4.

17. A motor vehicle comprising at least one lock unit of claim 5.

18. A motor vehicle comprising at least one lock unit of claim 8.

19. A motor vehicle comprising at least one lock unit of claim 12.

20. A motor vehicle comprising at least one lock unit of claim 13.

* * * * *